US005689828A

United States Patent [19]

Mah

[11] Patent Number: 5,689,828

[45] Date of Patent: Nov. 25, 1997

[54] PROTECTIVE GLOVE FOR BASEBALL

[76] Inventor: Jung Y. Mah, 251 Parkview Ave., Willowdale, Ontario, Canada, M2N 3Z3

[21] Appl. No.: 309,437

[22] Filed: Sep. 20, 1994

[30] Foreign Application Priority Data

Oct. 4, 1993 [GB] United Kingdom ..... 9320383

[51] Int. Cl.[6] ..... A41D 13/08

[52] U.S. Cl. ..... 2/16; 2/19; 2/20

[58] Field of Search ..... 2/2, 16, 19, 20, 2/159, 160, 161.1, 161.3, 161.5, 161.6, 161.8, 162, 163, 167, 169

[56] References Cited

U.S. PATENT DOCUMENTS

| | | | |
|---|---|---|---|
| 945,818 | 1/1910 | Sprague | 2/161.6 |
| 4,025,962 | 5/1977 | Hartung | 2/161.6 |
| 4,561,122 | 12/1985 | Stanley et al. | 2/19 |
| 4,638,511 | 1/1987 | Haack | 2/161.6 |
| 4,734,439 | 3/1988 | Norman | 2/162 |
| 4,894,866 | 1/1990 | Wallser | 2/161.6 |
| 4,958,384 | 9/1990 | McCrane | 2/161.6 |

*Primary Examiner*—C. D. Crowder
*Assistant Examiner*—Larry D. Worrell, Jr.
*Attorney, Agent, or Firm*—Patrick J. Hofbauer

[57] ABSTRACT

There is disclosed a partial glove for use on the hand of a wearer inside a conventional baseball catching glove. The glove is constructed of a textile material, preferably a stretchable textile material such as LYCRA spandex material, and is double layered on at least the palm (front) side, with a thin layer of resilient material interposed between the aforesaid two textile layers for impact protection of the wearer. The textile portion of the glove preferably surrounds only the proximal portions of the first (index) and second fingers of the wearer, with the thumb, third and fourth fingers fully uncovered. The thin layer of resilient material extends over at least the palm of the wearer and the front surface of the proximal portions of the first index and second fingers. In this manner, the wearer obtains the impact protection afforded by the thin resilient layer, without significant restriction of mobility or reduction in tactility.

12 Claims, 5 Drawing Sheets

PROTECTIVE GLOVE FOR BASEBALL

Another problem encountered in using a conventional baseball catching glove, is the development of blisters on the glove hand of the wearer.

A further problem encountered in using a conventional baseball catching glove is that the hand of the wearers tends to perspire, making the inner surfaces of the glove slippery and uncomfortable. This is particularly acute in warm summer weather.

To overcome these latter two problems, and as a wholly unsatisfactory attempt at solving the problem of hand injury as first described, some baseball glove wearers have resorted to wearer various forms of inner gloves inside of their baseball catching gloves. For example, it is known to wear a so-called "batter's glove" inside the baseball catching glove. This form of inner glove is a full glove constructed from textile or lightweight leather or synthetic leather, or a combination of both, which is secured about the wrist of the wearer by a VELCRO™ hook and loop system. However, such batter's gloves offer little protection against hand injury, although they may be useful in preventing blisters on the hand of the wearer. Moreover, because batter's gloves are fully enclosing, meaning that they fully enclose all of the fingers of the wearer, they do cause a significant loss of tactility for the wearer, and may, in fact, cause the wearer's hand to perspire more than if no glove at all were used.

Various other forms of gloves, for example, weightlifters gloves, have been worn by baseball players under their baseball catching gloves in an attempt to solve the aforementioned problems. None of these prior art gloves have, however, been entirely satisfactory for the intended usage, so that there remains a need for a new form of glove particulary suited for wearing in conjunction with a baseball catching glove to overcome the aforementioned problems. The glove of the present invention solves these problems by providing a novel form of partial glove that not only protects the most vulnerable areas of the wearer's hand from impact injury, i.e, the heel, the palm and the frontal, proximal area of the first and second (index) fingers, but also facilitates, by its manner of construction, design and choice of materials, a high degree of dexterity, tactility and mobility on the part of the wearer. Moreover, its non-fully encompassing structure allows the hand of the wearer to "breathe", so as to reduce perspiration. The preferred embodiment is constructed of a breathable material, such as a spandex material, which is not only elastically flexible for good fit and mobility, but also "breathable", so as to reduce perspiring of the wearer's hand.

Other advantages, features and characteristics of the present invention will become more apparent upon consideration of the following detailed description, with reference to the accompanying drawings, the latter of which is briefly described hereinbelow.

Figure 1:
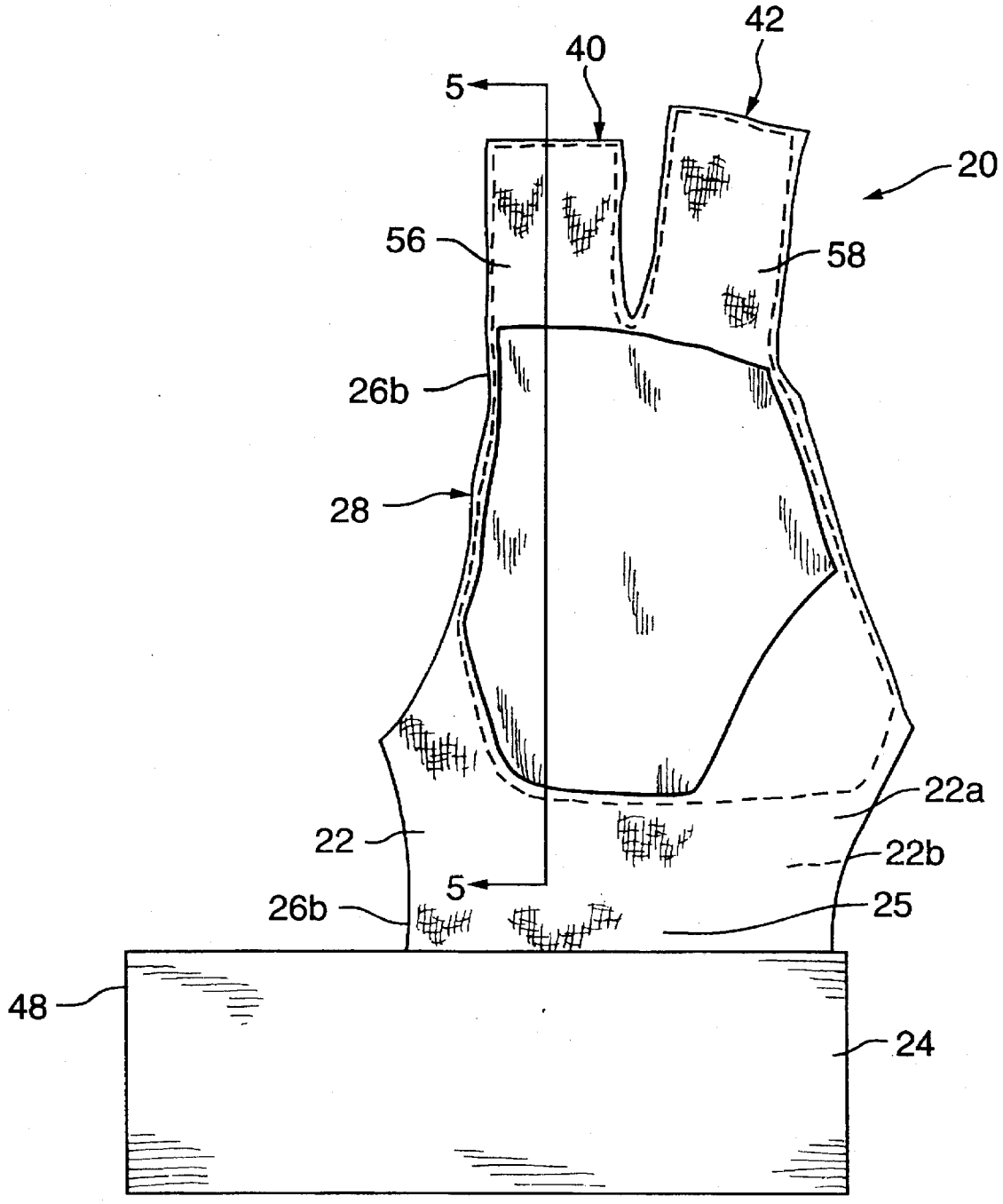
Figure 2:
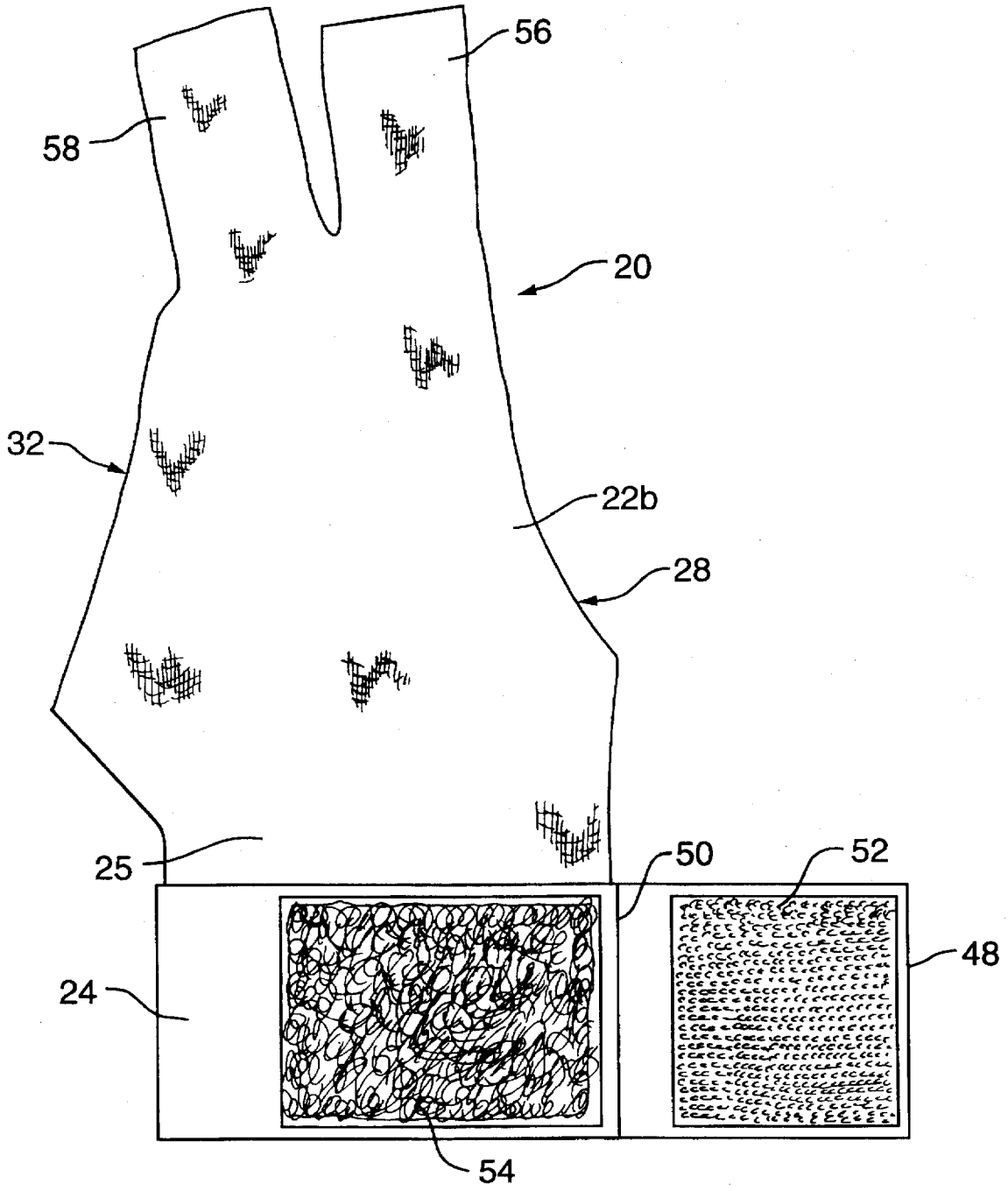
Figure 3:
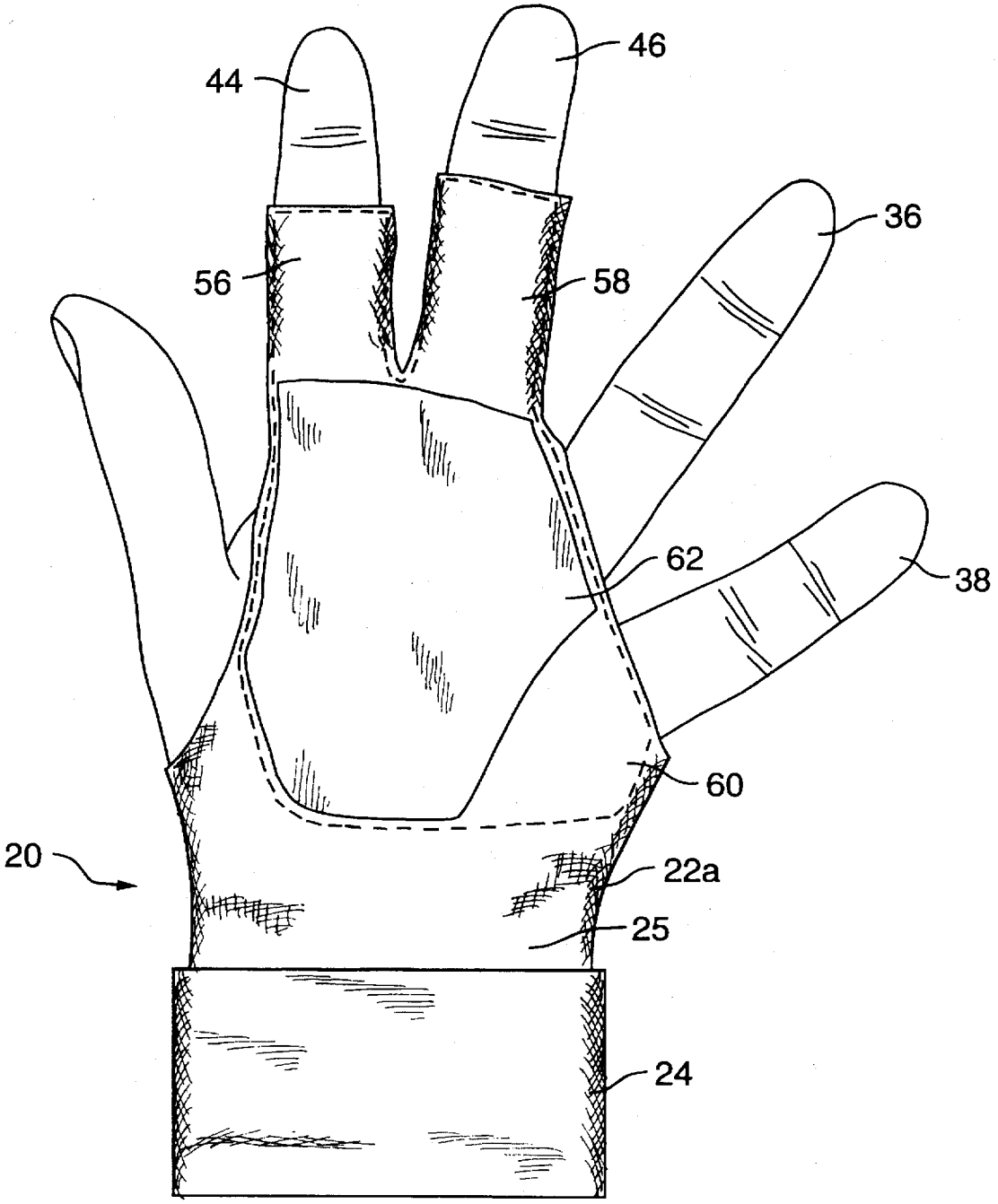
Figure 4:
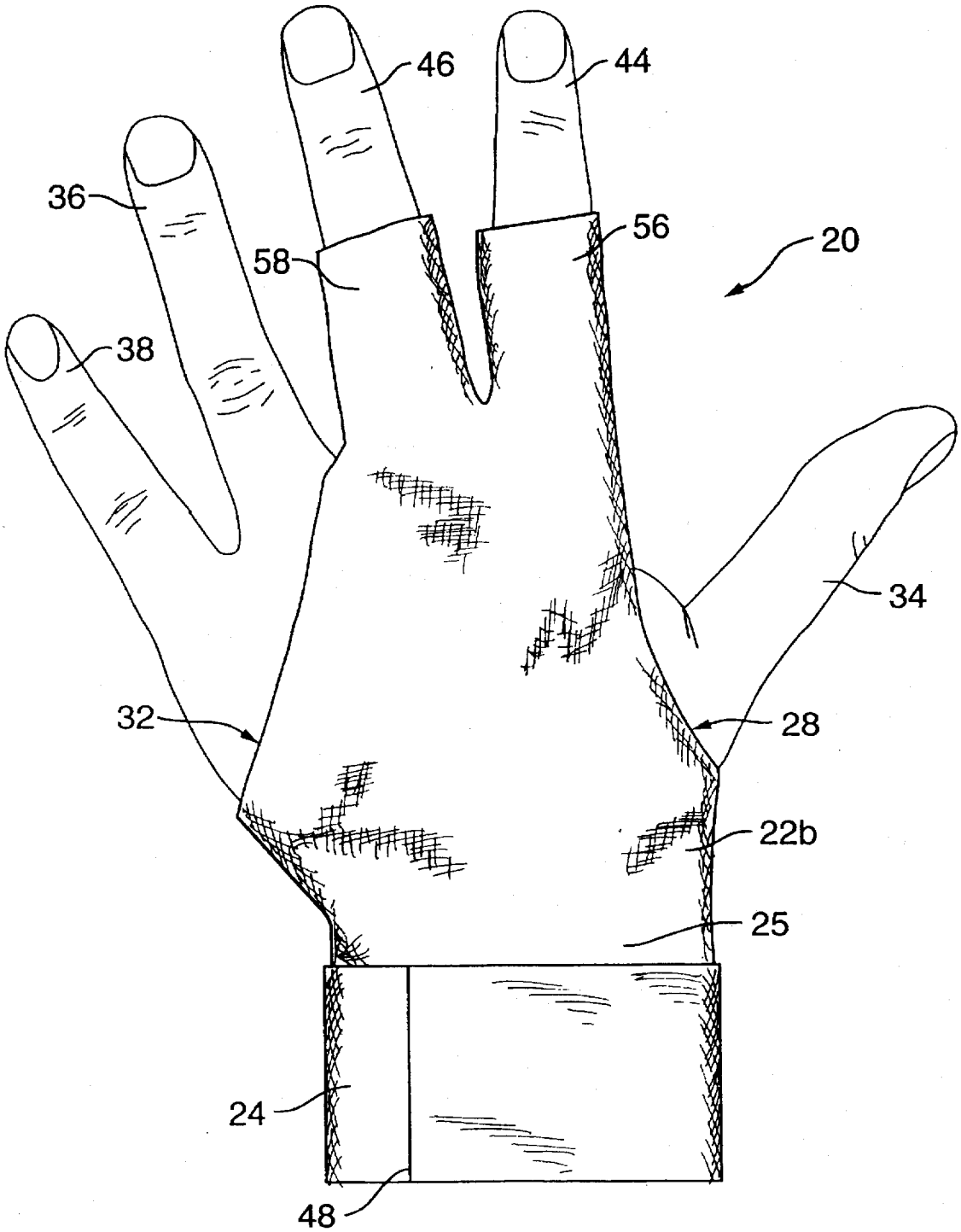
Figure 5:
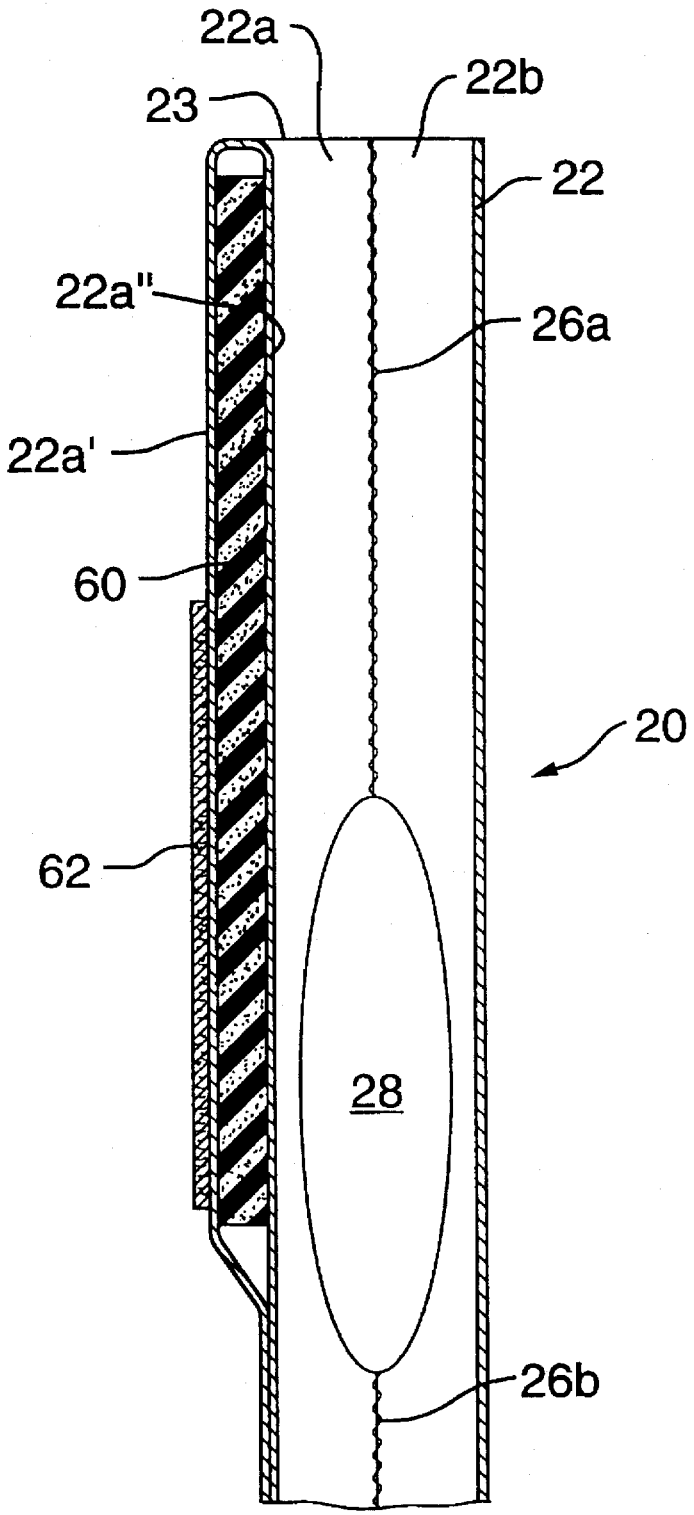

FIG. 1 of the drawings appended hereto is a top plan view of a preferred embodiment of partial glove according to the invention, being a left-handed version of the invention, shown with its wrist-band opened;

FIG. 2 of the drawings is bottom plan view of the partial glove of FIG. 1;

FIG. 3 of the drawings is a view similar to FIG. 1, with the partial glove being worn by a wearer, and the wrist-band closed;

FIG. 4 of the drawings is a view similar to FIG. 2, with the partial glove being worn by a wearer, and the wrist-band closed; and, FIG. 5 of the drawings is a sectional view along line 5—5 of FIG. 1.

Referring now to the drawings, there will be seen a preferred embodiment of partial glove according to the invention designated by the general reference numeral 20. The partial glove 20 comprises a main body portion 22 and a wrist-band portion 24. The main body portion 22 is itself preferably constructed of two halves, being a front half **22*a* and a back half 22*b*, which halves are mirror images of one another. Front half 22*a* is itself comprised of two separate layers, being outer layer 22*a*' and inner layer 22*a*", as best seen in FIG. 5. The outer layer 22*a*' and the inner layer 22*a*" are preferably cut from the same piece of textile material and folded over against one another along their top edge 23, as will again be best seen in FIG. 5. The front 22*a* and back 22*b* halves of the main body portion 22 are conventionally stitched together along their edges, as seen, for example, at seams 26*a* and 26*b*, so as to form a thumb hole 28 (which accommodates throughpassage of the wearer's thumb 34), a laterally opposed dual finger opening 32 (which accommodates the throughpassage of the wearer's third 36 and fourth 38 fingers), and finger openings 40 and 42 positioned at the top of finger extensions 56 and 58 (which opening 40 and 42 accommodate the throughpassage of the wearer's first 44 and second 46 fingers, respectively). While it is possible to form the main body portion 22 with only a single finger extension corresponding to finger opening 56 shown, it is preferable for reasons of durability and stability to form it with two finger extensions 56 and 58, as shown, which finger extensions respectively accommodate the first (index) 44 and second 46** fingers of the wearer.

The front **22*a* and back 22*b* halves of the main body portion 22 are each conventionally attached to a wrist-band portion 24** by, for example, stitching (not shown). Other conventional attachment means may also be used.

The two halves **22*a* and 22*b* of the main body portion 22, including the outer 22*a*' and inner 22*a*"** layers, are preferably constructed from a multi-directional stretchable textile material, such as LYCRA™ spandex material, thereby to snugly, resiliently fit the hand of the wearer. Spandex material is not only tear resistant, water resistant and breathable, (finding widespread use in the fabrication of bathing suits), but also allows, by reason of its stretchability, for the fabrication of a single adult glove size, or, at most, a limited number of glove sizes, such as, for example, small, medium and large sizes, to fully and snugly fit most adult wearer's. An additional smaller size may be necessary for children.

The wrist-band portion 24 is preferably made of a conventional elasticized textile material, which material is ideally stretchable only along its length, i.e., circumferentially around the wrist of the wearer. The wrist-band portion 24 substantially encircles a bottom portion 25 of the main body portion 22 (as seen in the appended drawings), and, in a conventional manner, loops back upon itself so that its first 48 and second 50 ends overlap in the closed configuration shown in FIGS. 3 and 4. Cooperating releasable fastening means are provided on each of the first 48 and second 50 ends of the wrist-band portion 24 to facilitate such closure. In the preferred embodiment illustrated, these fastening means are adjustable, releasable fastening means in the form of VELCRO™ hook and loop material. More specifically, a patch 52 of VELCRO™ hook material is sewn onto the underside of the wrist-band portion 24 at its first end 48, while a cooperating larger patch 54 of VELCRO™ loop material is sewn onto the outerside of the wrist-band portion 24. In this manner, the wrist-band can be adjustably, releasably closed by overlapping the patches 48 and 54 in cooperating fastening engagement.

Two further features of the present invention will now be described. The first is essential to the invention. The second is not, but is preferable.

It is essential to the present invention that there be interposed between the inner 22*a*" and the outer 22*a*' layers of the main body portion 22 a thin layer 60 of resilient, impact absorbing material. This material may be any flexible impact absorbing material, and includes, but is not limited to the following group of materials: natural or synthetic rubber; natural or synthetic rubber foams, with either open or closed cell structures; polymeric foams with open or closed structures, including but not limited to polyurethane foams and polystyrene foams; and, conventionally available impact absorbent gels, which may or may not require a pliable membrane containment pouch. One preferred resilient impact absorbing material is a synthetic rubber foam material available under the trade name VISCOLAS™ from Cabot Corporation, of Waltham, Mass., U.S.A.. The thin layer 60 is preferably from about 1/16" to 3/8" thick, and preferably between about 1/8" to 1/4" thick, and is configured, as best seen in FIG. 3, where it is shown in phantom outline, to extend over the heel and palm areas of the wearer's hand and preferably upward into the two finger extensions 56 and 58. In this manner, the areas most vulnerable to impact injury during catching of a baseball enjoy a significant measure of protection from the thin layer 60 which overlies them, while the third 36 fourth 38 and thumb 34 remain exposed and in contact with the catching glove, so that the wearer retains a proper "feel" for the glove and the ball. It is preferable, though not essential, that the finger extensions 56 and 58 and the thin layer 60 extend upwardly as shown in the appended drawings to cover the front of the respective first (index) 44 and second 58 fingers to the level of at least the proximal interphalangeal joint, and preferably to the level of the distal interphalangeal joint, so as to protect these vulnerable joints from impact injury.

It is optional to include a friction pad 62 over the main body portion 22 in the palm area of the partial glove 20 to prevent undue wear to the outer layer 22*a*' of the front half 22*a* of the main body portion 22. This friction pad 62 can be made from soft, flexible leather or synthetic leather, and is conventionally sewn in overlain relation to the front half 22*a* of the main body portion 22. As best seen in FIGS. 1 and 3, the friction pad is preferably smaller in area than the thin layer 60, and does not extend over the finger extensions 56 and 58 in order to promote flexibility of the fingers.

In summary of this disclosure, the present invention provides a novel partial glove for use on the hand inside a conventional baseball catching glove. The glove is constructed of a textile material, preferably a stretchable textile material such as spandex, and is double layered on at least the palm (front) side, with a thin layer of resilient material interposed between the aforesaid two textile layers for impact protection of the wearer. The textile portion of the glove preferably surrounds only the proximal portions of the first (index) and second fingers of the wearer, with the thumb, third and fourth fingers fully uncovered. The thin layer of resilient material extends over at least the palm of the wearer and the front surface of the proximal portions of the first (index) and second fingers. In this manner, the wearer obtains the impact protection afforded by the thin resilient layer, without significant restriction of mobility or reduction in tactility. Numerous modifications are possible within the scope of this invention.

I claim:

1. A partial glove for use by a wearer within a conventional baseball glove and comprising:

a main body portion having a front half and a back half securely joined together at portions of their respective edges, so as to form around the top perimeter of said main body portion a thumb hole, an opposed dual finger opening, and two finger extensions extending upwardly from said main body portion, with said two finger extensions being disposed between said thumb hole and said opposed dual finger opening, each of said two finger extensions having an individual finger opening in register therewith, and a hollow interior between said front and back halves;

said front half comprising outer and inner layers being securely joined together substantially around their respective edges;

a layer of resilient impact absorbing material interposed between said outer and inner layers and extending into each of said finger extensions; and, a wrist band portion securely attached to said main body portion so as to substantially encircle a bottom portion of the main body portion.

2. The partial glove of claim 1, wherein, when worn on the hand of said wearer, said two finger extensions each extend upwardly around the respective two fingers of the wearer to at least the level of the respective proximal interphalangeal joint of each of said two fingers.

3. The partial glove of claim 2, wherein, when worn on the hand of said wearer, said individual finger extensions each extend along the respective finger to at least the level of the distal interphalangeal joint.

4. The partial glove of claim 3, wherein said layer of resilient impact absorbing material is between about 1/16" and 3/8" in thickness.

5. The partial glove of claim 4, wherein said layer of resilient impact absorbing material is between about 1/8" and 1/4" in thickness.

6. The partial glove of claim 5, wherein said layer of resilient impact absorbing material is made from synthetic rubber material.

7. The partial glove of claim 6, wherein said layer of resilient impact absorbing material is made from a synthetic foam rubber material available under the trademark VISCOLAS.

8. The partial glove of claim 7, wherein said inner and outer layers of said front half are cut from a single piece of material and are folded over against one another to form said front half.

9. The partial glove of claim 8, wherein said front half and said back half of said main body portion are mirror images one of the other.

10. The partial glove of claim 9, further comprising a friction pad fastened over the palm area of the outer layer of the front half of the main body portion.

11. The partial glove of claim 10, wherein said friction pad is made from leather material.

12. The partial glove of claim 11, further comprising cooperating releasable fastening means on said wrist band portion so as to permit the wrist band to be adjustably, releasably closed around the wrist of a wearer.

* * * * *